US007901036B2

(12) United States Patent
Won

(10) Patent No.: US 7,901,036 B2
(45) Date of Patent: Mar. 8, 2011

(54) PRINT HEAD UNIT AND METHOD FOR MANUFACTURING PATTERNED LAYER ON SUBSTRATE WITH THE SAME

(75) Inventor: Chinchung John Won, Los Altos, CA (US)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 775 days.

(21) Appl. No.: 11/938,463

(22) Filed: Nov. 12, 2007

(65) Prior Publication Data

US 2009/0122095 A1 May 14, 2009

(51) Int. Cl.
*B41J 2/25* (2006.01)

(52) U.S. Cl. ..... 347/40; 347/108

(58) Field of Classification Search ..... 347/12, 347/40, 15, 43, 19, 108
See application file for complete search history.

(56) References Cited

U.S. PATENT DOCUMENTS

| | | | | |
|---|---|---|---|---|
| 6,412,903 | B1 * | 7/2002 | Lee et al. | 347/19 |
| 6,637,854 | B2 * | 10/2003 | Serra et al. | 347/19 |
| 2002/0145640 | A1 * | 10/2002 | Anderson et al. | 347/19 |

* cited by examiner

*Primary Examiner* — Lamson D Nguyen
(74) *Attorney, Agent, or Firm* — Jeffrey T. Knapp

(57) ABSTRACT

A print head unit (10) for manufacturing a patterned layer on a substrate is provided. The print head unit includes a first print head (12*a*), a second print head (12*b*), a third print head (12*c*), and a print head frame (11). The print head unit further includes parallelism adjusting means and position adjusting means. The parallelism adjusting means configured for rotationally moving at least one of the first print head and the third print head relative to the second print head so as to adjust parallelism between the first nozzle line, the second nozzle line, and the third nozzle line. The position adjusting means is configured for linearly moving at least one of the first print head and the third print head in the nozzle line direction.

13 Claims, 9 Drawing Sheets

PRINT HEAD UNIT AND METHOD FOR MANUFACTURING PATTERNED LAYER ON SUBSTRATE WITH THE SAME

BACKGROUND

1. Technical Field

The present invention generally relates to a print head unit, particularly, to a print head unit and a method for manufacturing a patterned layer on a substrate with the print head unit.

2. Discussion of Related Art

At present, methods for manufacturing a color filter include a pigment-dispersed method and an ink-jet method.

The pigment-dispersed method is widely used as a manufacturing method for color filters. The pigment-dispersed method uses color pigment photoresists forming red, green and blue sub-pixels by means of a spin-exposure-development process. Specifically, red pigment photoresist, blue pigment photoresist and green pigment photoresist are sequentially applied to a glass substrate with a black matrix, exposed to the ultraviolet-light with the help of a photomask after drying, and developed to form red sub-pixels, green sub-pixels and blue sub-pixels color layers respectively. Since the process has to be repeated three times or more, these manufacturing devices are both expensive to use and time-consuming to operate.

The ink-jet method uses an ink-jet device with at least one print head for depositing ink into a predetermined position on a substrate structure. A patterned layer is formed after solidifying the ink. Generally, for an area of the substrate structure is larger than a covering area of the print head, the print head of the ink-jet device move relatively in a matrix manner with the substrate to finish depositing the ink on the substrate.

The ink jet method is different from the pigment-dispersed method. In the ink jet method, each of R, G, and B ink is sprayed onto a substrate from respective nozzles of print heads to form a color layer. When the ink jet method is employed, the required amount of ink can be applied onto a required place at a specific time. Accordingly, almost no ink is wasted. Furthermore, since the sub-cells of R, G, and B can be formed simultaneously, the coloring time is reduced, and it is possible to markedly reduce cost.

Since the pitches between the nozzles of the conventional print head is invariable, the pitches of the nozzles may not match that of the corresponding cells in the color filter. In order to make the pitches between the nozzles and the cells match each other, it is necessary to rotate the print head about the axis perpendicular to the substrate, such that the projection of the nozzle pitches on the substrate in the direction perpendicular to the printing direction is as the same as that of the cells in the same direction.

What is needed, therefore, is a print head unit to hold and adjust the print heads in multi degree-of-freedoms independently such that the pitches of the nozzles match that of the cells.

SUMMARY

A print head unit for manufacturing a patterned layer on a substrate is provided. The print head unit includes a first print head, a second print head, a third print head, and a print head frame. The first print head includes a first nozzle line with a plurality of nozzles arranged in a line. The second print head includes a second nozzle line with a plurality of nozzles arranged in a line. The third print head includes a third nozzle line with a plurality of nozzles arranged in a line. The print head frame is configured for mounting the first print head, the second print head, and the third print head thereon. The first nozzle line, the second nozzle line, and the third nozzle line are substantially parallel with each other. The second print head is mounted between the first print head and the third print head. The first print head and the third print head are pivotally mounted on the print head frame. The print head unit further includes a parallelism adjusting means and a position adjusting means. The parallelism adjusting means configured for rotationally moving at least one of the first print head and the third print head relative to the second print head so as to adjust the parallelism between the first nozzle line, the second nozzle line, and the third nozzle line. The position adjusting means is configured for linearly moving at least one of the first print head and the third print head in the direction along the respective nozzle line thereof.

A print head unit for manufacturing a patterned layer on a substrate is provided. The print head unit includes at least two side print heads, one central print head disposed between the side print heads, and a print head frame. The side print heads and the central print head respectively include a nozzle line with a plurality of nozzles arranged in a line. The side print heads and the central print head are arranged in a manner that all the print heads are rotatable about a rotating axis of the print head unit and the nozzle line of the central print head crosses the rotating axis. The print head unit further includes a parallelism adjusting means and a position adjusting means. The parallelism adjusting means is configured for rotationally moving at least one of the side print heads relative to the central print head so as to adjust parallelism between the nozzle lines of the side print heads. The position adjusting means is configured for linearly moving the side print heads in the direction along the respective nozzle line thereof independently.

A method for manufacturing a patterned layer on a substrate with the print head unit is provided. The method including the steps of: mounting a print head unit to an ink-jet device, wherein the print head unit comprises at least two side print heads and one central print head disposed between the side print heads, the side print heads and the central print head each comprises a nozzle line with a plurality of nozzles arranged in a line, the side print heads and the central print head are arranged in a manner that all the print heads are rotatable about a rotating axis of the print head unit and the nozzle line of the central print head crosses the rotate axis; rotationally moving at least one of the side print heads relative to the central pint head to achieve parallelism between the side print heads and the central print head; rotating the print head unit around the rotate axis perpendicular to the substrate; linearly moving the side print heads in the direction along the respective nozzle line thereof to match pitches of the nozzles of the side print heads and that of the cells on the substrate; depositing ink into the cells on the substrate; and solidifying the ink so as to form a patterned layer on the substrate.

BRIEF DESCRIPTION OF THE DRAWINGS

Many aspects of the present print head unit and method for manufacturing a patterned layer on a substrate using the same can be better understood with reference to the following drawings. The components in the drawings are not necessarily drawn to scale, the emphasis instead being placed upon clearly illustrating the principles of the present print head unit and method. Moreover, in the drawings, like reference numerals designate corresponding parts throughout the several views.

Figure 1:
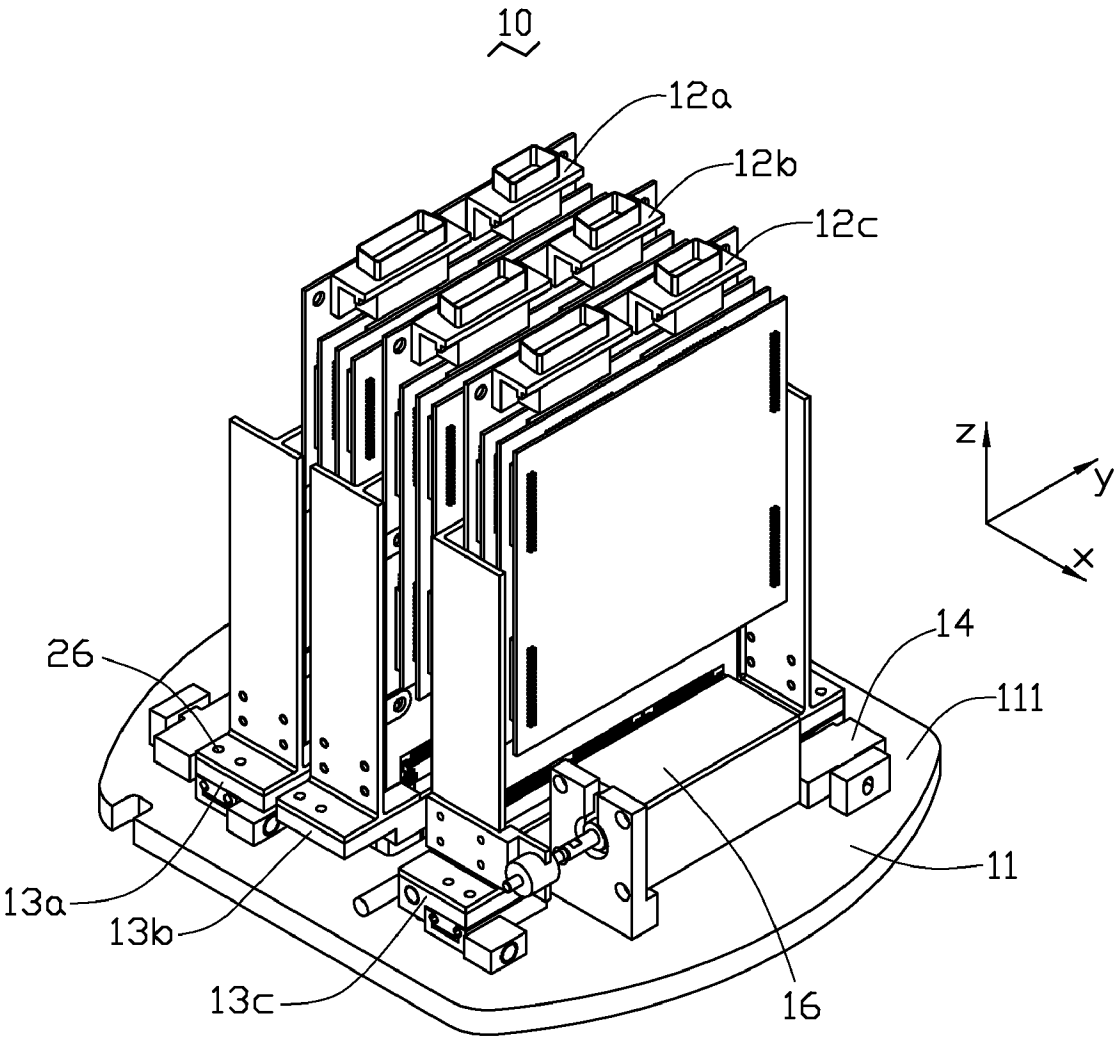
FIG. 1 is a perspective view of a print head unit in accordance with a preferred embodiment.

Corresponding reference characters indicate corresponding parts throughout the drawings. The exemplifications set out herein illustrate at least one preferred embodiment of the present print head unit and its related method, in one form, and such exemplifications are not to be construed as limiting the scope of the invention in any manner.

DETAILED DESCRIPTION OF THE EMBODIMENT

The preferred embodiments of the present invention will now be described with reference to the attached drawings. A print head unit including machined parts, sensors and actuators, is provided. The machined parts mainly include a print head frame, print heads, and adapter bars configured for holding print heads. The print heads and adapter bars are mounted on the print head frame. The sensors include optical encoders, capacitive sensors, or thermocouples. The actuators include screw adjusters, piezo actuators/motors, or stepper motors.

Figure 2:
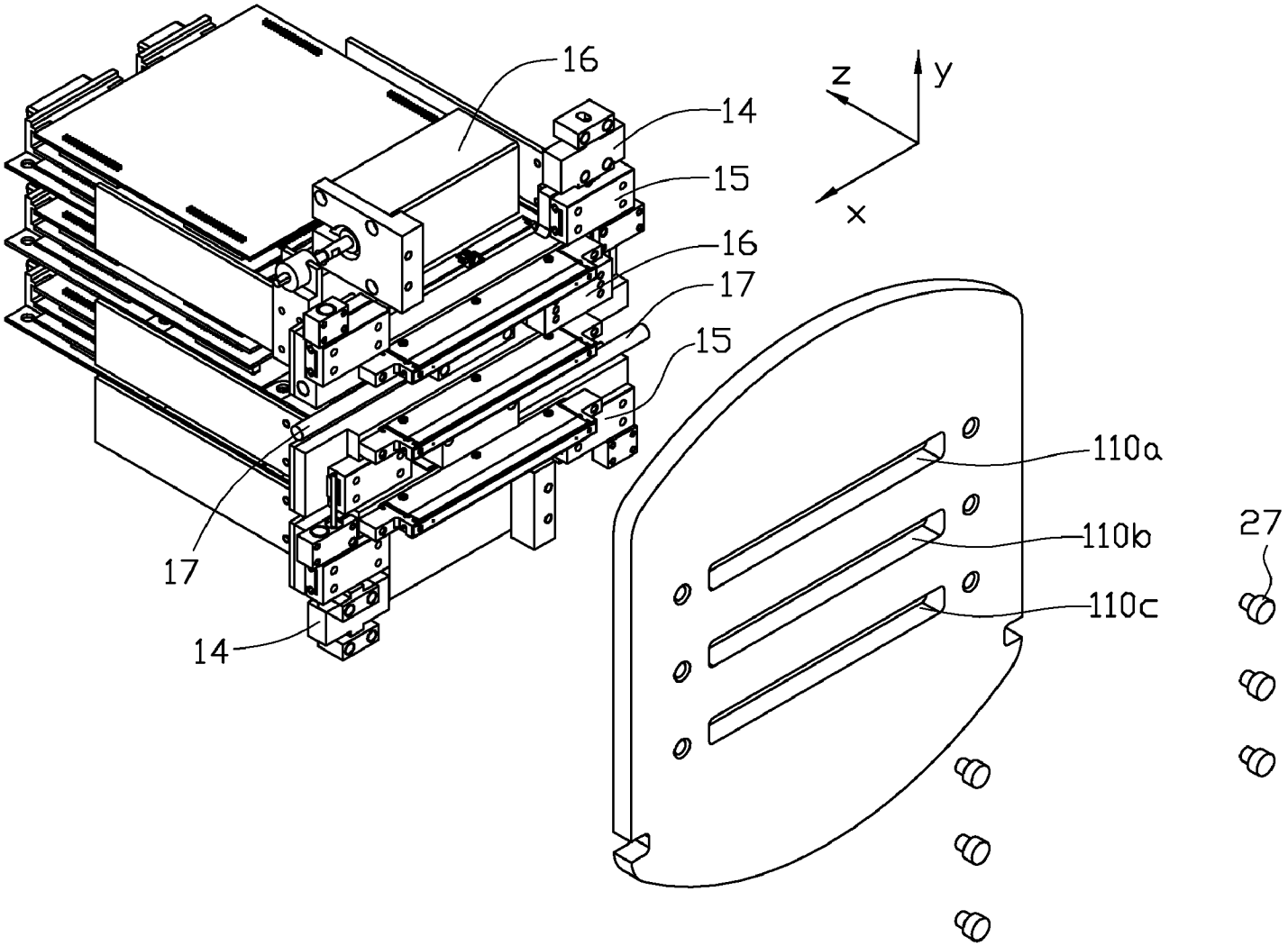
FIG. 2 is an exploded perspective view of the print head unit shown in FIG. 1.

With reference to FIGS. 1 and 2, a print head unit 10 includes a print head frame 11, print heads (12*a*, 12*b*, and 12*c*), and adapter bars (13*a*, 13*b*, and 13*c*) configured for holding the print heads (12*a*, 12*b*, and 12*c*). The print heads (12*a*, 12*b*, and 12*c*) and the adapter bars are (13*a*, 13*b*, and 13*c*) are mounted on the print head frame 11. The print head unit 10 can rotate about an axis that will be referred to as the z-axis in FIG. 1. To more thoroughly describe the location and the movement of the components in the print head unit 10, an x-axis runs horizontally as shown in FIG. 2 and y-axis runs vertically as shown in FIG. 2.

The print head 12*a* for discharging red (R) ink is mounted into the adapter bar 13*a* and locked by screws 26 at two ends of the print head 12*a*, the print head 12*b* for discharging green (G) ink is mounted in the adapter bar 13*b* and locked by screws 26 at two ends of the print head 12*b*, and the print head 12*c* for discharging blue (B) ink is mounted in the adapter bar 13*c* and locked by screws 26 at two ends of the print head 12*c*. The screws 26 can be adjusted to limit a rotation about x-axis and y-axis of the print heads (12*a*, 12*b*, and 12*c*) relative to the adapter bars (13*a*, 13*b*, and 13*c*).

The adapter bars (13*a*, 13*b*, and 13*c*) are mounted in apertures (110*a*, 110*b*, and 110*c*) on the bottom surface 111 of the print head frame 11, and bolted on the bottom surface 111 of the print head frame 11 by screws 27. The adapter bars (13*a*, 13*b*, and 13*c*) reside in the x-y plane. The screws 27 can be adjusted to limit nonrotational displacement of the print heads in the direction along z-axis. The apertures (110*a*, 110*b*, and 110*c*) are shaped to limit the rotation of the adapter bars (13*a*, 13*b*, and 13*c*) about x-axis and y-axis, and configured for determining and fixing the relative position between the print heads (12*a*, 12*b*, and 12*c*). It is to be understood that, the apertures (110*a*, 110*b*, and 110*c*) should have enough space, so that the adapter bars (13*a*, 13*b*, and 13*c*) mounted in the apertures (110*a*, 110*b*, and 110*c*) can move along x or y direction, or rotate in x-y plane. The print heads (12*a*, 12*b*, and 12*c*) receive ink from an ink reservoir (not shown) that is in communication with the print heads (12*a*, 12*b*, and 12*c*).

Figure 3:
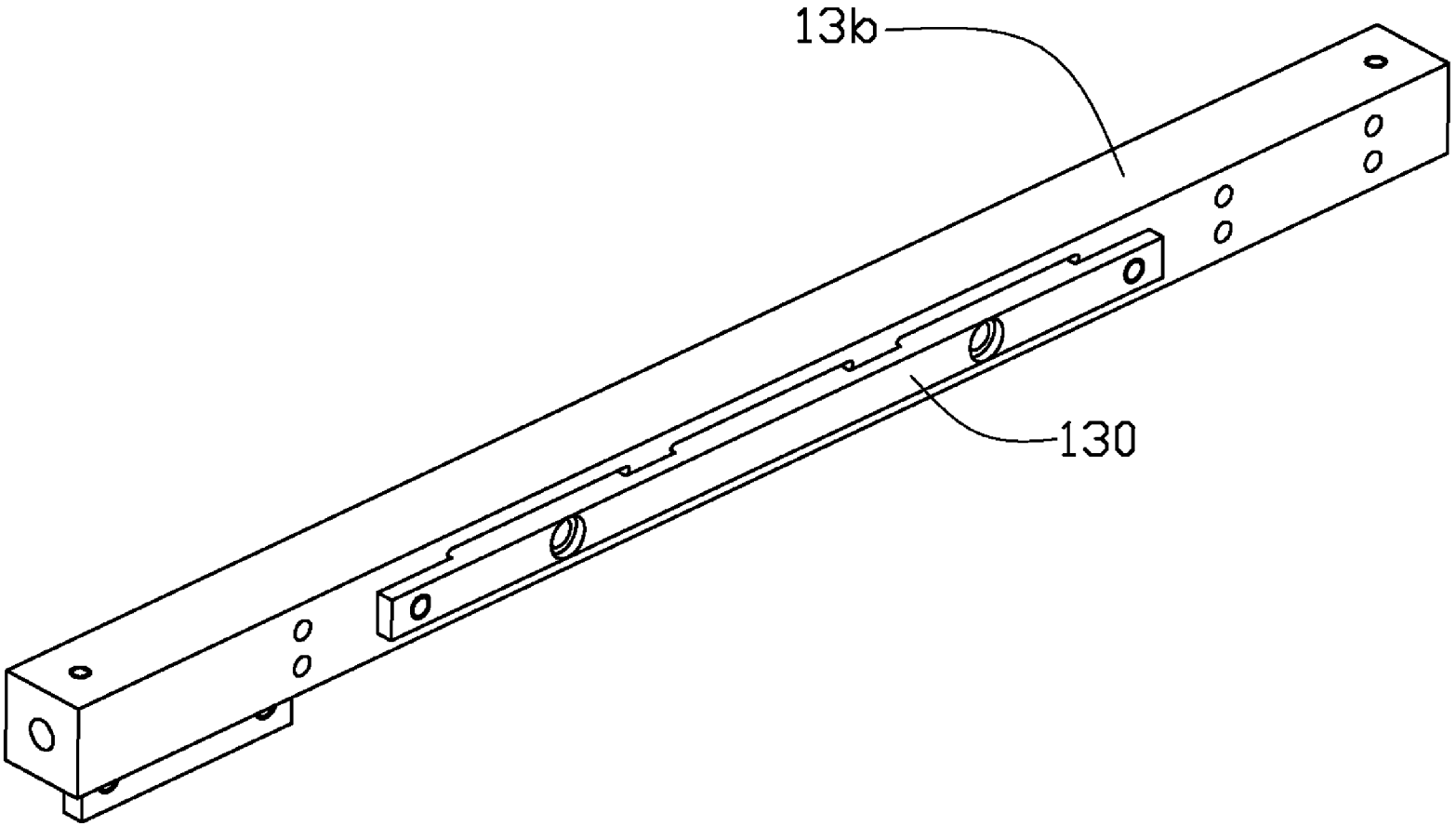
FIG. 3 is a perspective view of the adapter bar shown in FIG. 1.

Heater bars 130 are attached to respective adapter bars (13*a*, 13*b*, and 13*c*), the adapter bar 13*b* and the heater bar 130 are illustrated in FIG. 3 for example. Ink around the heater bar 130 can boil and for bubbles by supplying predetermined driving pulses (driving signals) to the heater bar 130. The volume expansion of the bubbles causes the ink to be pushed out from the nozzles, thus performing ink discharging. Accordingly, the size of bubbles can be adjusted by controlling the driving pulses applied to the heater bar 130, thereby controlling the volume of the ink discharged from the nozzles.

Figure 4:
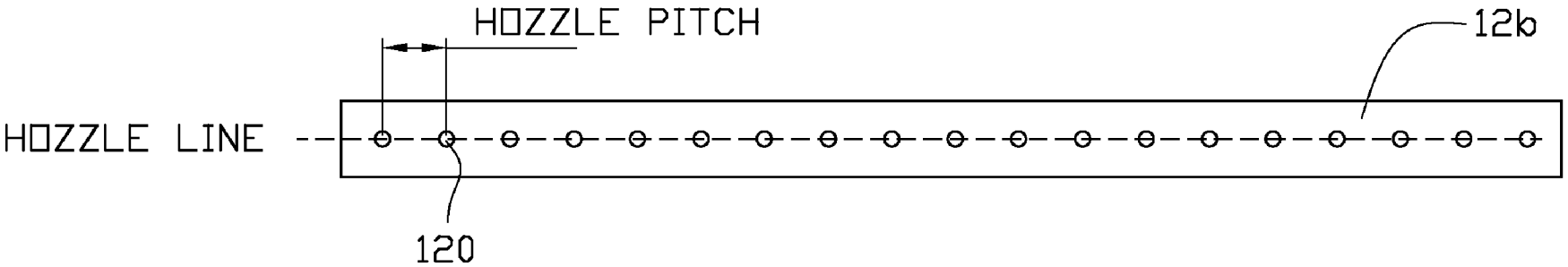
FIG. 4 is a schematic view of the print head shown in FIG. 1.

Referring to FIG. 4, each print head (12*a*, 12*b*, and 12*c*) includes a plurality of nozzles 120. The nozzles 120 in the preferred embodiment are spaced from one another along a line that is perpendicular to the z-axis, and the line is called nozzle line. The print heads (12*a*, 12*b*, and 12*c*) in the print head unit 10 are arranged in a manner that all the print heads (12*a*, 12*b*, and 12*c*) are rotated simultaneously and the nozzle line of the central print head 12*b* crosses the z-axis of the print head unit 10. The central print head 12*b* is fixed in the print head unit 10, that is to say the position of the adapter bar 13*b* for mounting the print head 12*b* is fixed on the bottom surface 111 of the print head frame 11. The nozzle lines of the side print heads (12*a* and 12*c*) are parallel with the nozzle line of the central print head 12*b* with predetermined spacing. In the process of making a color filter, the print heads (12*a*, 12*b* and 12*c*) deliver ink into cells in the color filter. It is to be understood that, a fewer or greater number of print heads can be provided.

Referring to FIGS. 1 and 2 again, piezoelectric motors 14 cooperate with capacitive sensors 15 to adjust the nozzle lines of the side print heads (12*a* and 12*c*) being parallel with the nozzle line of the central print head 12*b*. A first piezoelectric motor 14 is attached to one end of the print head 12*a* configured for moving the print head 12*a* in a traverse direction depart from or near to the nozzle line of the central print head 12*b* in one end, while the other end of the print head 12*a* is pivoted. A second piezoelectric motor 14 is attached to one end of the print head 12*c* to parallel the print head 12*c* with the print head 12*b* in the same way as described above.

The parallelism of the side print heads (12*a* and 12*c*) with respect to the central print head 12*b* can be sensed with the capacitive sensors 15 disposed in between and connected to the side print heads (12*a* and 12*c*) and the central print head 12*b*. Various configurations are known in the art for such capacitive sensors 15 and the piezoelectric motors 14, and in many cases a particular electrode configuration can provide either function. Motion of the print head 12*a* with respect to the central print head 12*b* is sensed by measuring capacitance between one end of the print head 12*a* and the print head 12*b*, and measuring capacitance between the other end of the print head 12*c* and the print head 12*b*. Motion of the print head 12*c* with respect to the print head 12*b* is sensed in the same way described above. The piezoelectric motors 15 can actuate the side print heads (12*a* and 12*c*) by closing a loop with the capacitive sensors 14.

It is necessary to rotate the print head unit, in the event of using an print head unit with nozzle pitches which do not match the cell pitches. For example, in the event of performing angle adjustment of the print head unit 10, the print head unit 10 is rotated by an amount of theta around z axis. So that the nozzle pitches in the x direction of the print head 12*b* matches the cell pitches of the R cells in the x direction. Thus, the nozzle pitches of the print head 12*b* match the cell pitches on the substrate. However, the nozzle pitches of the side print heads (12*a* and 12*c*) do not match the cell pitches on the substrate.

Stepper motors 16 cooperate with optical encoders 17 to move the side print heads (12*a* and 12*c*) in the direction along the nozzle line independently, such that the projection of the nozzle pitches on the substrate in the direction perpendicular to the scanning direction is the same as that of the cells in the same direction. A first stepper motor 16 is attached to the other end of the print head 12*a* for moving the print head 12*a* in the direction along the nozzle line of the print head 12*a*. A second stepper motor 16 is attached to the other end of the print head 12*c* for moving the print head 12*c* in the direction alone the nozzle line of the print head 12*c*. The position of the side print heads (12*a* and 12*c*) in the direction along the nozzle line can be sensed with the optical encoders 17 disposed in between and connected to the side print heads (12*a* and 12*c*). The stepper motors 16 are assisted with the optical encoders 17 for the position correction. To ensure the submicron accuracy, a resolution of the optical encoder 17 is 0.1 μm below.

Figure 5:
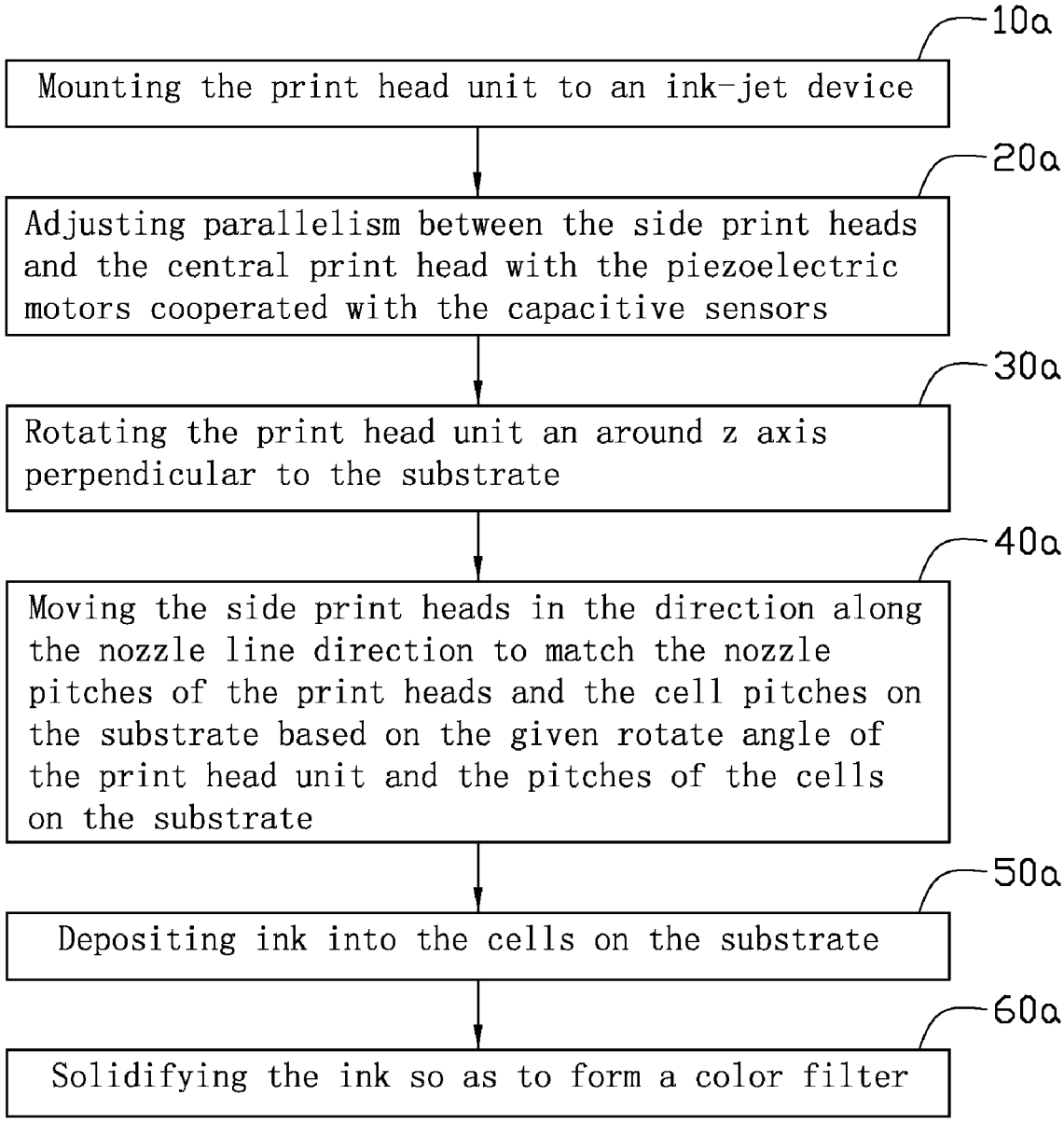
FIG. 5 is a flowchart illustrating a method for manufacturing a color filter on a substrate in accordance with the preferred embodiment.

Referring to FIG. 5, a flow chart of the operation process of coloring a color filter using the print head unit 10 is shown. The process mainly includes the steps of: (10*a*) mounting the print head unit 10 to an ink-jet device; (20*a*) adjusting parallelism between the side print heads (12*a* and 12*c*) and the central print head 12*b* with the piezoelectric motors 14 cooperated with the capacitive sensors 15; (30*a*) rotating the print head unit 10 around z axis perpendicular to the substrate; (40*a*) moving the side print heads (12*a* and 12*c*) in the direction along the nozzle line to match the nozzle pitches of the print heads (12*a*, 12*b*, and 12*c*) and the cell pitches on the substrate based on the given rotate angle of the print head unit 10 and the pitches of the cells on the substrate; (50*a*) depositing ink into the cells on the substrate; (60*a*) solidifying the ink so as to form a color filter. The operation of coloring a color filter using the print head unit 10 will be described in details below.

In step 10*a*, the print head unit 10 is mounted to an ink-jet device. In the present embodiment, a bubble jet type print head unit 10 is used, but the piezo-jet type print head unit may also be used.

In step 20*a*, a voltage is applied to the piezoelectric motors 14, thereby adjusting the spacing between the side print heads (12*a* and 12*c*) and the central print head 12*b*. The voltage is determined by the capacitive sensors 15. The piezoelectric motors 14 actuate the print head (12*a* and 12*c*) by closing a loop with the capacitive sensors 15.

The parallelism between the side print heads (12*a* and 12*c*) and the central print head 12*b* can be adjusted by the step mentioned above alone, but further parallelism adjustment is preferable in order to manufacture a better color filter with defects such as mixing of colors and blank spots being reduced even further. With the present embodiment, the steps including step 200*a* and step 200*b* described next are subsequently performed.

Figure 6:
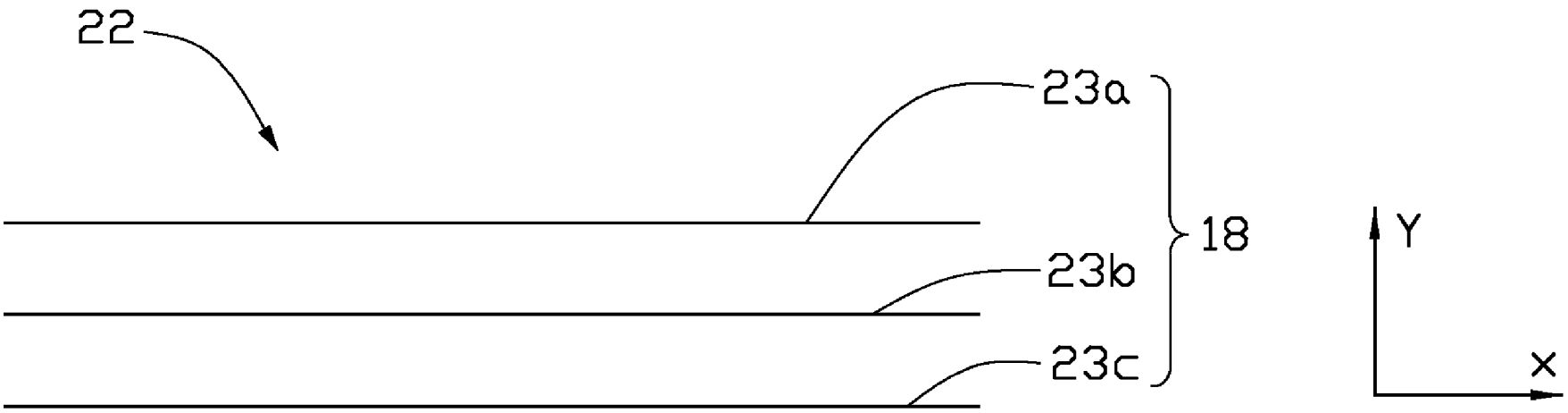
FIG. 6 is a diagram illustrating a first ink dot placement pattern.

Firstly, in step 200*a*, ink is discharged toward the substrate 22 from the nozzles of the print heads (12*a*, 12*b*, and 12*c*), thereby forming a first ink dot placement pattern 18. During the process, the print head is not moved, and the plane resided with the three nozzle lines of the print heads (12*a*, 12*b*, and 12*c*) is parallel to the substrate 22. FIG. 6 shows the ink dot lines (23*a*, 23*b*, and 23*c*) of the print heads (12*a*, 12*b*, and 12*c*).

Secondly, in step 200*b*, the ink dot placement pattern 18 is identified, and a judgment is made about whether there is parallelism offset in the ink dot placement pattern 18. If there is no parallelism offset in the ink dot placement pattern 18, it means that the parallelism adjustment has been performed correctly, and thus the parallelism adjustment of the print heads (12*a*, 12*b*, and 12*c*) is completed. On the other head, if there is a positional offset in the ink dot placement pattern 18, a re-adjustment is needed. It means that the piezoelectric motors 14 will actuate the print heads (12*a*, 12*b*, and 12*c*) by closing a loop with the capacitive sensor 15. The parallelism adjustment of the print heads is completed, until the re-adjustment eliminates the parallelism offset.

Figure 7:
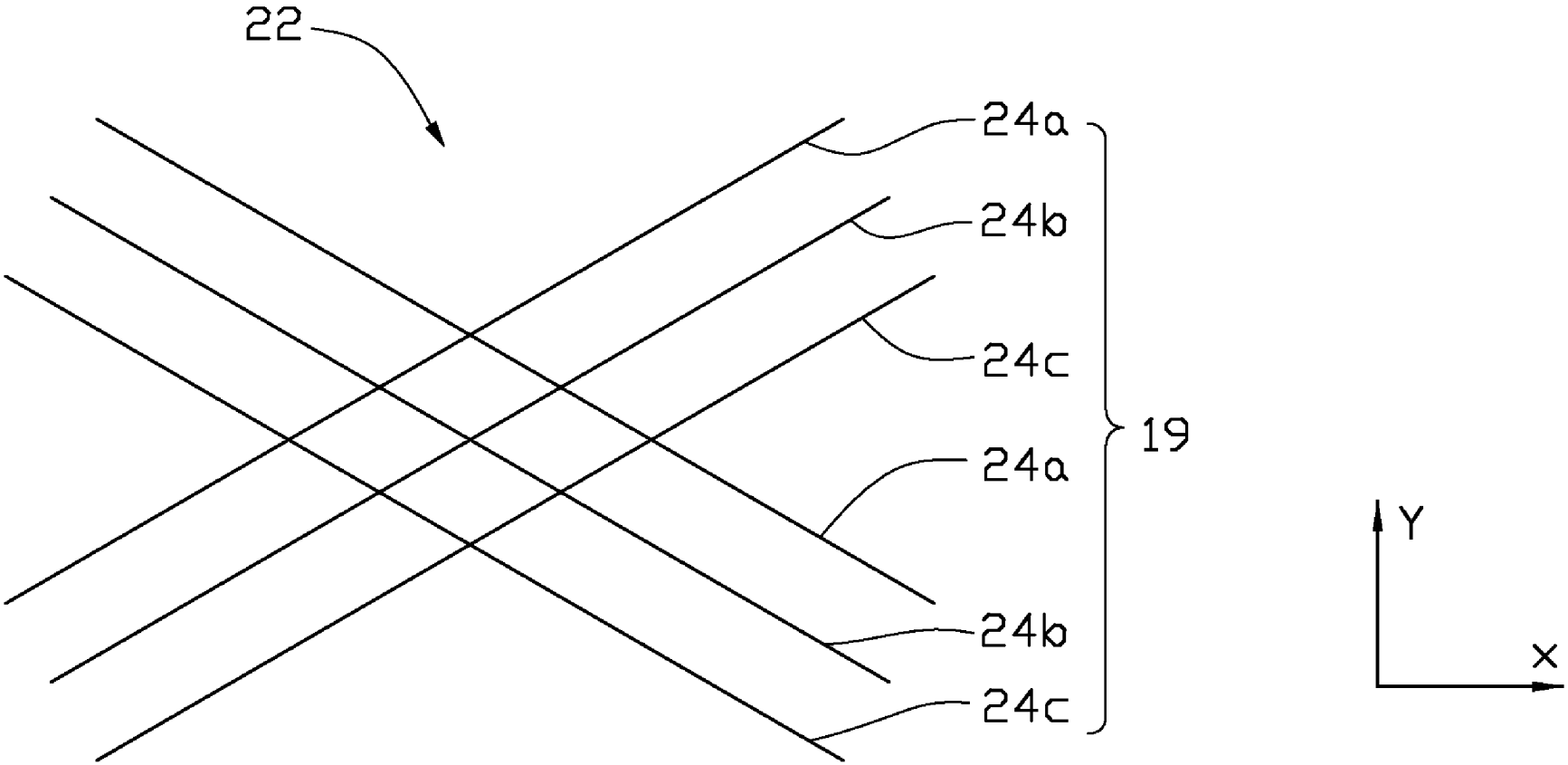
FIG. 7 is a diagram illustrating a second ink dot placement pattern.

Once the parallelism of the print heads is achieved, another two set of data is required when the print head unit 10 is rotated at two different angles, e.g., −30° and 30° with x direction around z axis. Firstly, ink is discharged toward the substrate 22 from the nozzles of the print heads (12*a*, 12*b*, and 12*c*) when the print head unit 10 is rotated at two different angles separately, thereby forming a second ink dot placement pattern 19. Then position of a rotate center O of the print head unit is calculated. FIG. 7 shows the ink dot lines (24*a*, 24*b*, and 24*c*) of the print heads (12*a*, 12*b*, and 12*c*) in two different angles together with the rotate center O.

Figure 8:
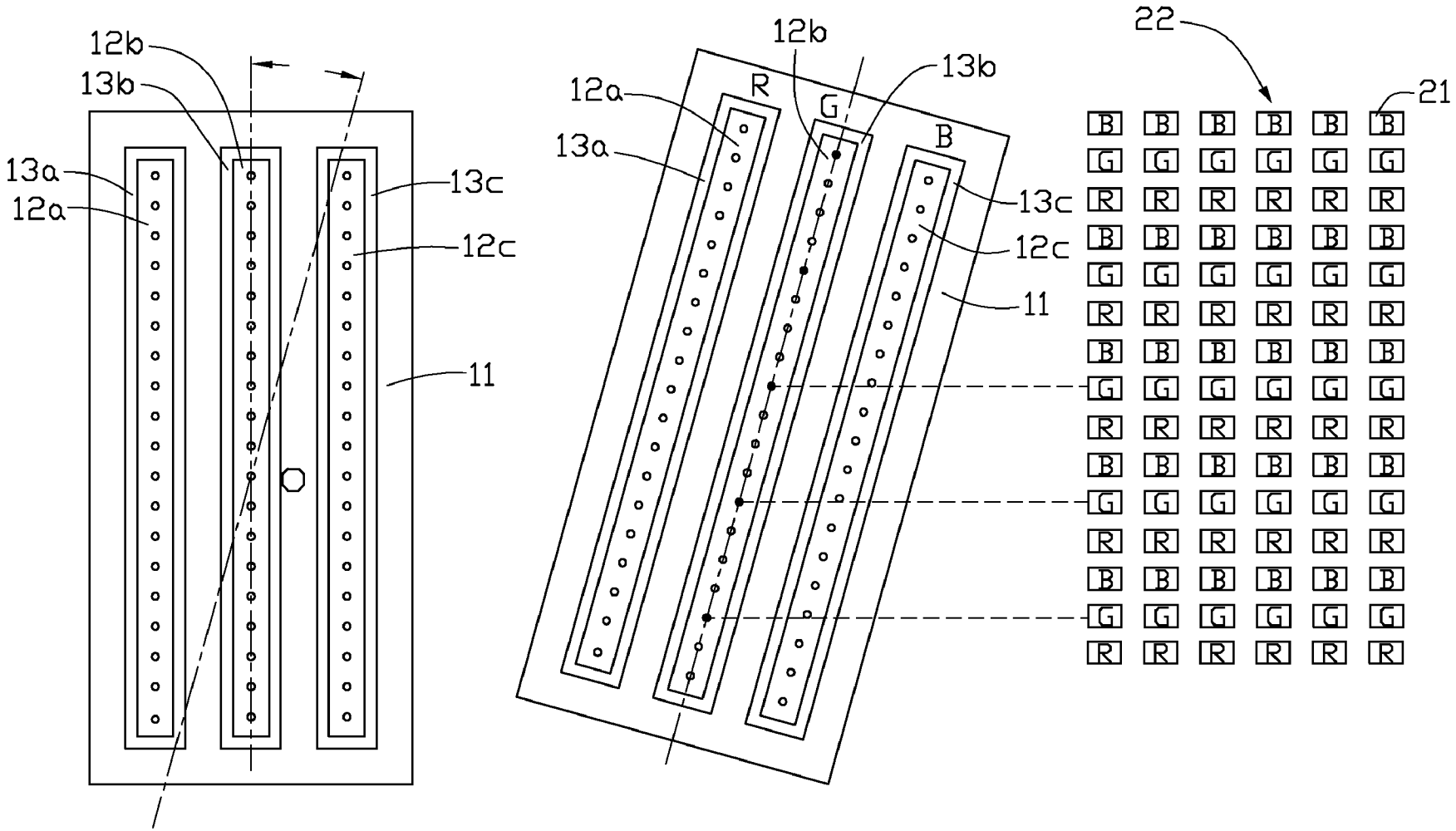
FIG. 8 is a diagram a state when the print head unit in FIG. 1 rotates an angle theta around a rotate center calculated by the second ink dot placement pattern in FIG. 7.
Figure 9:
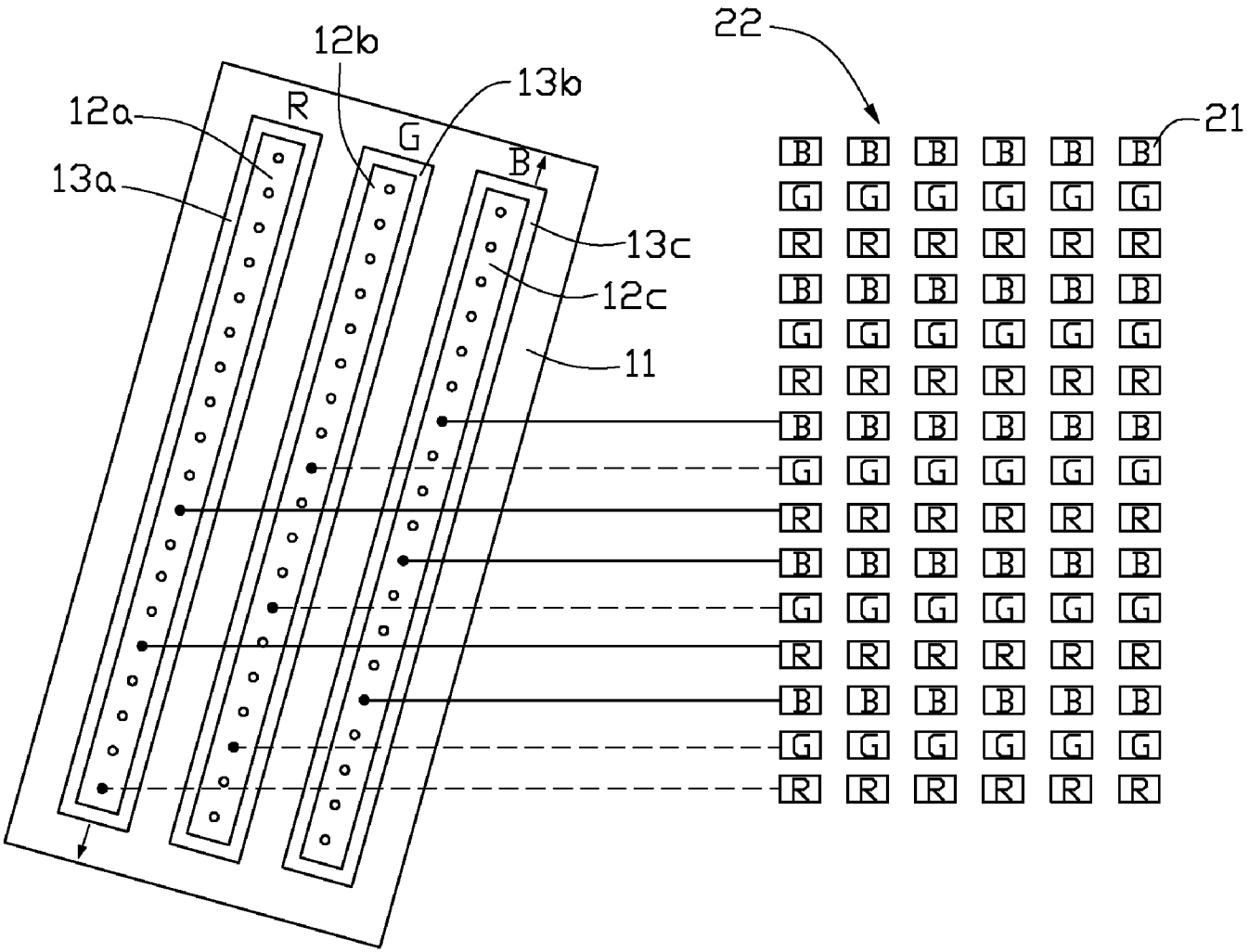
FIG. 9 is a diagram a state when the print head unit is adjusted after rotating theta around the rotate center so as to match the cell pitch of the color filter.

Referring to FIGS. 8 and 9, in step 40*a*, firstly, the print head unit 10 is rotated by an amount of theta around the rotate center O, so that the nozzle pitches in the x direction of the print head 12*b* matches the cell pitches of the R cells in the x direction. Then, the adapter bars (13*a* and 13*c*) are moved in the direction along the nozzle line. The position adjustment is performed for the adapter bars (13*a* and 13*c*), so that cells 21 on the substrate 22 can additionally be colored with the print heads 12*a* and 12*c*. The adapter bars (13*a* and 13*c*) are actuated by the stepper motors, which cooperate with the optical encoders. In order to determine whether the position of the nozzles is correctly adjusted, the steps including step 400*a* and step 400*b* described next are subsequently performed. In the step 400*a* after moving the adapter bars (13*a* and 13*c*) in the direction along the respective nozzle line of the adapter bars (13*a* and 13*c*), ink is discharged in the substrate to form a third ink dot placement pattern. Then, in the step 400*b* the third ink dot placement pattern is read, and the re-adjustment is made based on the reading results. If the re-adjustment eliminates the positional offset, the coloring of the color filter is started, i.e. the step 50*a* is started.

Although the present embodiment described involves the re-adjustment of the parallelism between the print heads (12*a*, 12*b*, and 12*c*) being performed before rotating the print head unit 10, an arrangement may be used wherein the re-adjustment is performed after completing the rotate center O adjustment of the print head unit 10 and the positional adjustment of the adapter bars (13*a*, 13*b*, and 13*c*). In this step, positional offset in the ink dot placement is eradicated by performing at least one of: parallelism adjustment between the print heads (the adjustment in steps 200*a* and 200*b*), the rotate center O adjustment of print heads, and adjustment of the adapter bars in the direction along the nozzle line (the adjustment in step 30*a*).

According to the present embodiment thus described, a print head unit for holding and adjusting the print heads in multi degree-of freedoms independently to adjust the nozzle pitches of the print heads (12*a*, 12*b*, and 12*c*) match cell pitches on the substrate is provided. The positional adjustment between the print heads can be easily performed even in the event that the number of print heads being used is increased, and consequently, prolonged periods of time are no longer necessary for positioning the print heads such as conventionally occurred due to the increase in the number of print heads, and also the color filter is manufactured using print head unit having multiple print heads of the same color, so the area which can be colored at once is wider than with conventional arrangements, which leads to proportionate reduction in coloring time. Also, large substrate can be colored by proportionately increasing the number of heads, thereby allowing color filters to be manufactured without reducing production.

Note that the above description has been made with reference to an example of a print head unit used with an apparatus for manufacturing a color filter, but the same can be used in manufacturing EL formed by applying self-illuminating material (EL light-emitting material) in recession surrounded by partitions provided upon a substrate. Further other than such color filters and EL display devices, the same can be used in manufacturing display device panels formed by discharging display material on a substrate.

It is to be understood that the above-described embodiment is intended to illustrate rather than limit the invention. Variations may be made to the embodiment without departing from the spirit of the invention as claimed. The above-described embodiments are intended to illustrate the scope of the invention and not restrict the scope of the invention.

What is claimed is:

1. A print head unit for manufacturing a patterned layer on a substrate, the print head unit comprising:

a first print head comprising a first nozzle line with a plurality of nozzles arranged in a line;

a second print head comprising a second nozzle line with a plurality of nozzles arranged in a line;

a third print head comprising a third nozzle line with a plurality of nozzles arranged in a line;

a print head frame with the first print head, the second print head, and the third print head mounted thereon, the first nozzle line, the second nozzle line, and the third nozzle line being substantially parallel with each other, wherein the second print head is mounted between the first print head and the third print head, and the first print head and the third print head are pivotally mounted on the print head frame;

parallelism adjusting means for rotationally moving at least one of the first print head and the third print head relative to the second print head so as to parallel the second nozzle line to the first and third nozzle lines; and position adjusting means for linearly moving at least one of the first print head and the third print head in the direction along the respective nozzle line thereof.

2. The print head unit as claimed in claim 1, wherein the first print head is configured for discharging red ink, the second print head is configured for discharging green ink, and the third print head is configured for discharging blue ink.

3. The print head unit as claimed in claim 1, wherein the print head unit further comprises a first adapter bar, a second adapter bar, and a third adapter bar configured for respectively holding the first print head, the second print head, and the third print head.

4. The print head unit as claimed in claim 3, wherein the second adapter bar is fixed and the first and third adapter bars are movable relative to the second adapter bar.

5. The print head unit as claimed in claim 4, wherein the first print head, the second print head, and the third print head are mounted in the respective first, second and third adapter bars by screws.

6. The print head unit as claimed in claim 3, wherein the print head frame comprises a bottom surface, a plurality of apertures is defined on the bottom surface, and the adapter bars are mounted in the apertures and bolted on the bottom surface of the print head frame by screw.

7. The print head unit as claimed in claim 1, wherein the parallelism adjusting means comprises at least one piezoelectric motor and at least one capacitive sensor, and the at least one piezoelectric motor is configured for actuating the first print head and the second print head by closing a loop with the at least one capacitive sensor.

8. The print head unit as claimed in claim 7, wherein a first piezoelectric motor is attached to one end of the first print head, a second piezoelectric motor is attached to one end of the third print head.

9. The print head unit as claimed in claim 7, wherein the at least one capacitive sensor is disposed between the second print head and at least one of the first print head and the third print head.

10. The print head unit as claimed in claim 1, wherein the position adjusting means comprises at least one stepper motor and at least one optical encoder, the at least one stepper motor and the at least one optical encoder cooperating to move the first print head and the third print head in the nozzle line direction independently.

11. The print head unit as claimed in claim 10, wherein a first stepper motor is attached to one end of the first print head, a second stepper motor is attached to one end of the third print head.

12. The print head unit as claimed in claim 10, wherein a resolution of the optical encoder is not greater than 0.1 μm.

13. A print head unit for manufacturing a patterned layer on a substrate, the print head unit comprising:

at least two side print heads, one central print head disposed between the side print heads, and the side print heads and the central print head each comprising a nozzle line with a plurality of nozzles arranged in a line, wherein the side print heads and the central print head are structured and arranged in a manner that all the print heads are rotatable about a rotating axis of the print head unit and the nozzle line of the central print head crosses the rotating axis;

parallelism adjusting means for rotationally moving at least one of the side print heads relative to the central print head so as to parallel the nozzle lines of the side print heads to the nozzle line of the central print head; and position adjusting means for linearly moving the side print heads in the direction along the respective nozzle line thereof independently.

* * * * *